United States Patent [19]

Krause, Jr.

[11] Patent Number: 4,577,265

[45] Date of Patent: Mar. 18, 1986

[54] ELECTRIC GASLIGHT SIMULATIVE

[76] Inventor: A. Frank Krause, Jr., P.O. Box 190, Fairfax, Va. 22030

[21] Appl. No.: 671,500

[22] Filed: Nov. 15, 1984

[51] Int. Cl.[4] ..... F21M 3/14

[52] U.S. Cl. ..... 362/255; 362/186; 431/125

[58] Field of Search ..... 431/125; 362/186, 189, 362/255, 359, 806

[56] References Cited

U.S. PATENT DOCUMENTS 2,457,666 12/1948 Harjes ..... 362/186

3,148,835 9/1964 Horelick ..... 362/255

*Primary Examiner*—Carroll B. Dority, Jr.

*Attorney, Agent, or Firm*—Harvey B. Jacobson

[57] ABSTRACT

An electric gaslight simulative for installation in an existing light fixture by merely screw threading the simulative into an existing light bulb socket after a conventional light bulb has been removed therefrom thereby converting the light fixture into a light which produces a glow or illumination quite similar to that produced by an actual gaslight and having external physical appearance characteristics simulative of an actual gaslight. The simulative includes an adapter constructed of insulative material having a screw threaded brass cap on one end thereof for insertion into the existing light bulb socket with a smaller light bulb socket being mounted on the adapter and receiving a generally cylindrical light bulb that telescopes into a generally cylindrical, closed end mantle of glass cloth or similar material with the mantle being supported removably from the adapter body and being supported by a wire frame with both the mantle and wire frame being removable to enable replacement of the elongated cylindrical light bulb. The open end of the mantle is provided with a reinforcing metallic foil tape bonded thereto with the open end of the mantle and tape being received telescopically into a peripheral groove formed in the body of the adapter.

12 Claims, 4 Drawing Figures

ELECTRIC GASLIGHT SIMULATIVE

BACKGROUND OF THE INVENTION

1. Field of the Invention

The present invention generally relates to an electric gaslight simulative that can be screw threaded into existing light fixtures such as post lamps, entrance lights, hanging fixtures, chandeliers or in any other type of indoor or outdoor light fixture in order to produce a light simulative of a gaslight thereby enabling all of the beneficial appearance characteristics of a gaslight to be enjoyed without requiring actual installation of a gaslight and without requiring a gas supply. The electric gaslight simulative includes an adapter socket constructed of insulative material and provided with a screw base or cap attached thereto for screw threaded engagement into a conventional existing light socket and a smaller screw threaded light socket for receiving the base of a longitudinally elongated tubular bulb having a glass cloth mantle positioned thereon with the lower open end of the mantle being provided with a metallic foil tape received in a channel or groove in the adapter socket and the outer closed end of the mantle being removably supported from the adapter socket by a wire frame of generally U-shaped configuration having the ends of the legs thereof received in sockets provided in laterally extending ears or lugs on the adapter socket.

2. Description of Related Art

Prior U.S. Pat. Nos. 1,350,853 and 2,158,304 disclose gas-lighting devices utilizing a mantle of the type generally used in conjunction with a gas flame to produce a gaslight having well known desirable appearance characteristics. U.S. Pat. No. 2,383,116 discloses a screen-like cover attached to a conventional incandescent light bulb and U.S. Pat. No. 3,225,186 discloses a simulative candle associated with various types of light bases.

None of the prior art mentioned above discloses any type of device by which an existing electric light fixture having one or more existing light sockets therein can be provided with an assembly which simulates a gaslight and produces a light closely simulative of a gaslight.

SUMMARY OF THE INVENTION

An object of the present invention is to provide an electric gaslight simulative in the form of an adapter socket which can be screw threaded into an existing light socket in an existing light fixture and includes a unique structure for supporting a glass cloth mantle and a longitudinally elongated light bulb therefrom which is closely simulative in appearance to a gaslight mantle and produces a light having appearance and illumination characteristics simulative of a conventional gaslight thereby enabling an electric light fixture to be quickly and easily converted to a fixture having the appearance characteristics and illumination characteristics of a gaslight.

Another object of the invention is to provide an electric gaslight simulative in which the glass cloth mantle is supported by a generally U-shaped wire frame having the ends of the legs received in sockets provided in the adapter socket to enable removal of the mantle for replacement of the bulb with the end of the mantle adjacent the adapter socket being provided with metallic foil tape of gold or other color to reinforce the open end of the mantle and retain it in a peripheral groove or channel provided therefor in the adapter socket thereby providing a final structure that is attractive in appearance and closely simulative of a gaslight.

A further object of the invention is to provide an electric gaslight simulative in which the adapter socket and its related components including the screw threaded socket base or cap and the smaller screw threaded socket receiving the bulb base are of conventional brass or other metallic construction with the components being secured together by conventional riveting procedures which enables the device to be constructed of relatively inexpensive components which can be easily and inexpensively assembled thereby retaining the cost of the simulative at a desired reasonable level.

Still another object of the invention is to provide an electric gaslight simulative which can be easily and quickly installed in an existing light socket and can be used in vertically depending or upstanding position or used in any angular position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
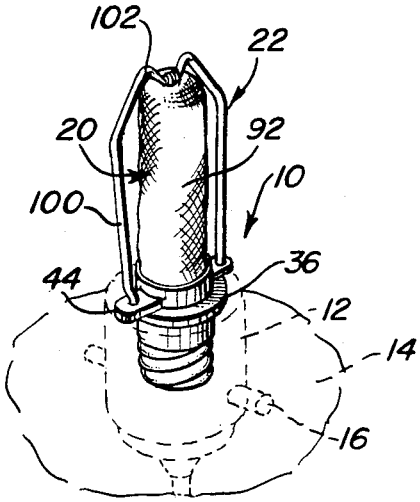
FIG. 1 is a perspective view of the electric gaslight simulative of the present invention illustrating a typical installation in an existing light socket of an existing light fixture.

Referring now specifically to the drawings, the electric gaslight simulative of the present invention is generally designated by the numeral 10 and is adapted to be screw threaded into an existing light socket 12 supported by and forming a part of an existing light fixture 14 in which the socket 12 includes a conventional switch structure 16. The light fixture 14 may include a single light socket or multiple light sockets and may be oriented in any position. For example, the light fixture may be incorporated into a post lamp, wall mounted lamp at an entranceway, various hanging fixtures, chandeliers or the like with the simulative 10 of the present invention merely being screwed into the existing light socket 12 in lieu of a conventional electric light bulb.

The electric gaslight simulative 10 includes an adapter socket 18 supporting a mantle generally designated by the numeral 20 and a wire frame generally designated by the numeral 22 and a light bulb generally designated by the numeral 24.

Figure 4:
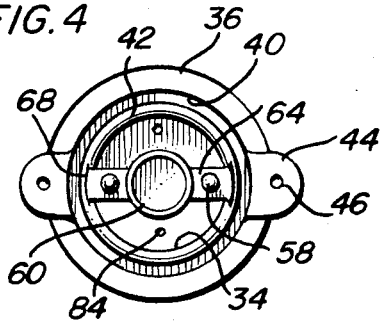
FIG. 4 is a top plan view of the adapter socket illustrating the structural details thereof.

The adapter socket 18 includes a cylindrical body 26 having a flat lower end surface 28 with a centrally disposed depending projection 30 which includes parallel side walls and inclined end walls. The cylindrical body 26 includes an upwardly extending peripheral wall 32 defining a cylindrical interior cavity 34. The outer surface of the peripheral wall 32 inclines outwardly and includes a cylindrical flange 36 adjacent the upper edge thereof with the external surface of the wall 32 including shoulders 38 with the uppermost shoulder 38 forming the lower edge of the flange 36. The upper surface of the flange 36 includes a peripheral upwardly opening channel or groove 40 with the inner wall of the groove 40 being defined by the upper edge portion of the cavity 34 designated by numeral 42 which extends above the upper surface of the flange 36 and also slightly above a pair of laterally extending ears or lugs 44 which are integral with opposite portions of the upper surface of the flange 36 and have their inner edges defined by the curvature of the groove or channel 40 as illustrated in FIG. 4. Each of the ears or lugs 44 is provided with a socket 46 therein for mounting the wire frame 22 in a manner set forth hereinafter with the inner end of the mantle 20 being received in the groove or channel 40 in a manner described hereinafter. The body 26, extension 30 and wall 32 including the lugs or ears 44 are of one piece unitary construction and preferably are constructed of conventional insulating material such as plastic, rubber or the like.

Figure 3:
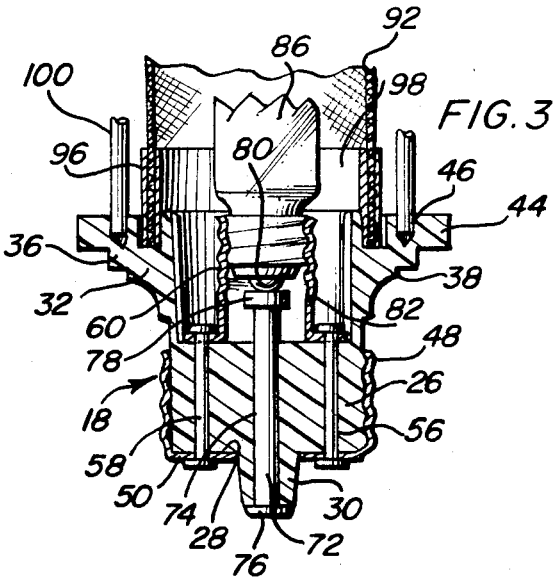
FIG. 3 is a vertical sectional view of the end of the electric gaslight simulative adapted to be received in the existing light socket illustrating the structural details thereof.
Figure 2:
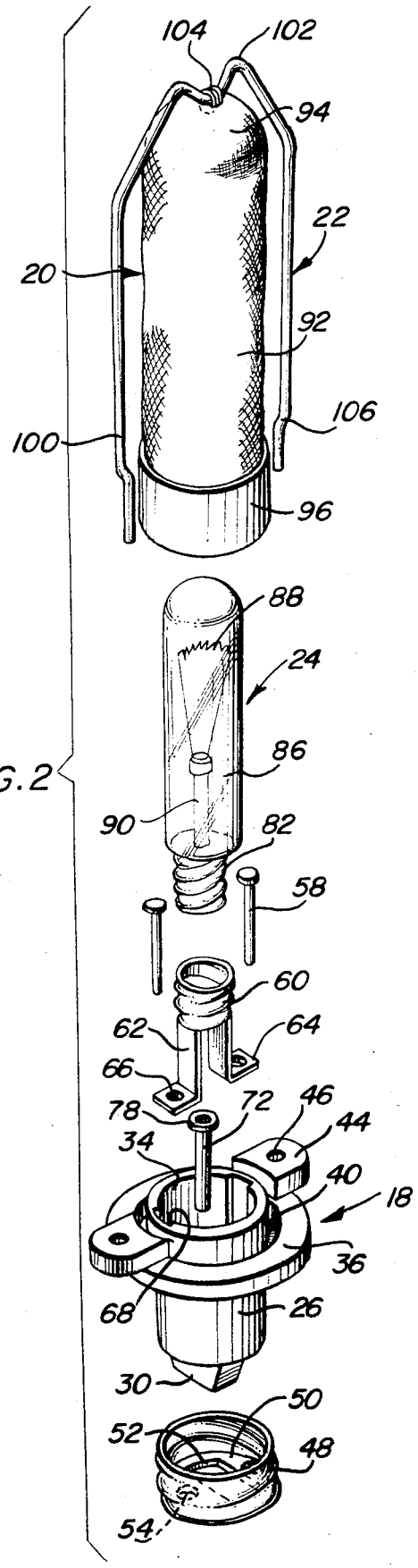
FIG. 2 is an exploded group perspective view of the components of the present invention.

The socket adapter 18 also includes a screw threaded socket base or cap 48 having an inwardly extending bottom 50 provided with an opening 52 which closely receives the projection 30 as illustrated in FIG. 3 with the rectangular configuration of the opening 52 corresponding with the generally rectangular configuration of the projection 30 thereby rotationally orienting the cap 48 so that apertures 54 on the opposite sides thereof are aligned with passageways 56 extending through the body 26 into the interior of the cavity 34 to facilitate insertion of fastening rivets 58 to secure the cap 48 in place on the body 26 as illustrated in FIG. 3. Positioned interiorly of the cavity 34 is a screw threaded socket 60 of brass or similar conductive material with opposite side edges of the inner edge of the socket including elongated legs 62 terminating in outwardly extending feet or flanges 64 each of which includes an aperture 66 therein for receiving the rivet 58 as illustrated in FIG. 3 thereby mechanically and electrically connecting the socket 60 with the socket base or cap 48. The length of the legs is such that the screw threaded bulb socket 60 is elevated in the cavity 34 to a position adjacent the open upper end thereof as illustrated in FIG. 3. Also, each of the opposite sides of the cavity 34 is provided with a vertical groove 68 which extends throughout the length of the cavity and receives the outer ends of the feet or flanges 64 thereby locating and positioning the apertures 66 in alignment with the passageways 56 so that the rivets 58 can be easily inserted through the apertures 66, passageways 56 and apertures 54 to facilitate the assembly and riveting of these components together. A central rivet or rod 72 extends through a passageway 74 with the lower headed end 76 being disposed externally of the projection 30 and the upper headed end 78 being disposed centrally of the socket 60 between the legs 62 to engage with the projecting contact 80 on the bulb base 82 of the bulb 24 thereby providing an easily assembled and relatively inexpensive arrangement of components with the body 26 also including small apertures 84 for moisture drainage.

The light bulb 24 includes an elongated cylindrical transparent envelope 86 with the bulb base 82 connected thereto in a conventional manner with the envelope including a filament 88 located adjacent the outer end thereof and a standoff support and insulator 90 to orient the filament 88 adjacent the end of the envelope 86 remote from the base 82 so that the light produced by the light bulb will be oriented nearer the end of the envelope 86 remote from the base 82. The threaded base 82 threads into the socket 60 and makes contact therewith with the contact 80 centrally of the bulb base 82 and insulated therefrom contacting the rod or rivet 72 in a well known manner.

The mantle 20 includes a generally cylindrical or tubular member of woven glass cloth 92 having a closed outer end 94 and a metallic foil tape 96 encircling the outer surface of the open end thereof and a metallic foil tape 98 oriented inwardly of the open end of the glass cloth member 92 to reinforce the open end of the mantle and to be received telescopically into the groove or channel 40 as illustrated in FIG. 3 thereby providing a decorative and reflective external surface for the open end portion of the mantle 20 and also reinforcing and stabilizing the open end of the glass cloth member 92 and providing frictional engagement with the walls of the groove 40 to secure the open end of the mantle in position.

The wire frame 22 includes a pair of wire legs 100 interconnected by a bight portion 102 with the bight portion being of shallow V-shaped configuration with the center of the inwardly extending shallow V being connected to the closed end 94 of the mantle 20 by looped threads 104 which may be of fabric or metallic material. The legs 100 are provided with shallow angulated portions 106 and the wire frame is constructed of resilient wire material so that the ends of the legs 100 are spaced apart slightly greater than the distance between the sockets 46 so that in order to insert the ends of the legs into the sockets 46, they must be biased together and then released after insertion to frictionally retain the wire frame in place. This enables easy removal of the wire frame 22 and mantle 20 to replace the bulb 24 when necessary. Also, this enables the adapter socket 18 to be easily screwed into an existing light socket in an existing light fixture. Inasmuch as the components of the adapter socket 18 are of conventional material, the body 26 and the peripheral wall 32 may be formed by using conventional techniques and procedures and the metallic components, constructed of brass or the like, can be easily assembled and secured permanently in position in the adapter sockets so that the adapter socket can be easily handled and manipulated and the mantle and frame may be easily positioned on the adapter socket and removed therefrom when necessary. The positioning of the light bulb and filament therein with respect to the outer end portion of the mantle 20 produces the desired illumination and closely simulates the physical characteristics of appearance of a gaslight and also produces illumination closely simulative of that produced by a gaslight thereby enabling all of the characteristics of a gaslight to be enjoyed without the necessity of actually installing a gaslight and without the necessity of having a gas supply available.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An electric gaslight simulative for threaded engagement with a light bulb socket in an electric light fixture comprising an adapter socket having a threaded conductive cap for threading into a light socket, said adapter socket including a body of insulative material on which the cap is mounted, a conductive light bulb socket smaller than the socket in the light fixture mounted on said body in electrical contact with the cap, a central conductive member mounted in the body and extending into the smaller socket from the opposite end of the body in insulated relation to the cap to energize a light bulb screwed into the smaller light socket, a mantle mounted on the body in enclosing relation to a light bulb in the smaller socket and a supporting wire frame connected to the body and extending alongside the mantle and supporting the outer end of the mantle to simulate a gaslight when the light bulb within the mantle is energized.

2. The simulative of claim 1 wherein said body includes a pair of laterally extending ears having a socket therein, said wire frame including spaced legs having terminal ends frictionally and detachably secured in the sockets in the ears to enable removal of the wire frame and mantle for replacement of the bulb.

3. The simulative as defined in claim 2 wherein said mantle is constructed of flexible glass cloth having a closed outer end, means securing the closed outer end of the mantle to the wire frame, the inner end of the mantle being open and provided with a peripheral reinforcing member to stabilize the open end of the mantle.

4. The simulative as defined in claim 3 wherein the means stabilizing the open end of the mantle includes an inner tape and an outer tape extending peripherally of the open end of the mantle with at least the outer tape being constructed of metallic foil having a reflective outer surface and an adhesive inner surface for mounting on the mantle.

5. The simulative as defined in claim 4 wherein said body includes a peripheral channel forming an outwardly opening groove telescopically receiving the open end of the mantle with the metallic foil tape being on both the inside and outside of the mantle for reinforcement of the mantle and forming a telescopic frictional engagement with the groove in the body.

6. The simulative as defined in claim 5 wherein said body includes a cavity opening opposite to the cap with the smaller light socket being disposed in the cavity with the light bulb being an elongated generally cylindrical bulb having a filament adjacent the outer end thereof for positioning the source of light adjacent the outer end of the filament thereby closely simulating the glow produced by a gaslight with a mantle.

7. The simulative as defined in claim 6 wherein said smaller bulb socket includes a pair of axially extending legs with outwardly extending flanges on the lower ends thereof with each of the legs including an aperture therethrough, rivet means extending through the apertures in the legs of the smaller bulb socket and extending through the body and through apertures in the cap for mechanically and electrically connecting the smaller bulb socket with the cap.

8. The simulative as defined in claim 7 wherein said cavity in the body includes oppositely disposed longitudinal, inwardly facing grooves slidably receiving the ends of the flanges on the legs to position the apertures in the flanges on the legs in aligned relation with passageways extending through the body.

9. The simulative as defined in claim 8 wherein said body includes a projection of generally rectangular configuration thereon in opposed relation to the smaller bulb socket, said cap including an opening of corresponding shape to the projection for angularly orienting the cap in relation to the body for aligning apertures in the cap with passageways in the body for receiving fastening rivets connecting the flanges on the legs with the cap.

10. The simulative as defined in claim 9 wherein the centrally disposed conductor extends through the projection and through a passageway in the body to the central interior portion of the smaller bulb socket for engagement with the contact in the center of the base of the bulb.

11. An assembly to enable an electric light fixture to be converted to a simulated gaslight comprising an adapter having external screw threads for screw threaded engagement into the light socket on the light fixture, said adapter including a smaller light bulb socket adapted to receive a smaller bulb base, a flexible glass cloth mantle supported from the adapter in a distended position in enclosing relation to a generally cylindrical light bulb whereby illumination of the light bulb will produce a light glow similar to that produced by a gaslight.

12. The adapter as defined in claim 11 together with means detachably supporting the mantle from the adapter to enable removal and replacement of the light bulb.

* * * * *